US011393670B2

(12) United States Patent
Kodera

(10) Patent No.: US 11,393,670 B2
(45) Date of Patent: Jul. 19, 2022

(54) MALDI MASS SPECTROMETER AND STORAGE MEDIUM RECORDING PROGRAM FOR MALDI MASS SPECTROMETER

(71) Applicant: SHIMADZU CORPORATION, Kyoto (JP)

(72) Inventor: Kei Kodera, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/173,292

(22) Filed: Feb. 11, 2021

(65) Prior Publication Data

US 2021/0249245 A1 Aug. 12, 2021

(30) Foreign Application Priority Data

Feb. 12, 2020 (JP) ..... JP2020-021324

(51) Int. Cl.
*H01J 49/16* (2006.01)
*H01J 49/00* (2006.01)

(52) U.S. Cl.
CPC ..... *H01J 49/164* (2013.01); *H01J 49/0004* (2013.01)

(58) Field of Classification Search
CPC ..... H01J 49/164; H01J 49/0004
See application file for complete search history.

(56) References Cited

FOREIGN PATENT DOCUMENTS

JP 2018-036100 A 3/2018

OTHER PUBLICATIONS

"MALDImini™-1 Digital Ion Trap Mass Spectrometer", disclosed on Shimadzu Corporation's website, 10pages.

*Primary Examiner* — Nicole M Ippolito
*Assistant Examiner* — Hanway Chang
(74) *Attorney, Agent, or Firm* — Sughrue Mion, PLLC

(57) ABSTRACT

In order to display an image which enables easy observation of the state of adhesion of a sample regardless of the kind of matrix, its distribution and other factors in a MALDI mass spectrometer configured to irradiate a sample on a sample plate (15) with laser light to ionize a component in the sample and perform a mass spectrometric analysis, the MALDI mass spectrometer includes: a plurality of light source units (30*a*, 30*b*), each configured to emit a beam of light with a different wavelength distribution; an illumination light switching section (42, 31) configured to selectively cast one of the beams of light emitted from the light source units, onto the sample plate as illumination light; and an imaging section (32) configured to acquire an optical image of the sample plate formed by the illumination light, the imaging section being common to the light source units.

16 Claims, 7 Drawing Sheets

VISIBLE-LIGHT IMAGE

ULTRAVIOLET-LIGHT IMAGE

VISIBLE-LIGHT IMAGE

SWITCHING INSTRUCTED BY USER

ULTRAVIOLET-LIGHT IMAGE

VISIBLE-LIGHT IMAGE

AUTOMATIC SWITCHING AT REGULAR INTERVALS OF TIME

ULTRAVIOLET-LIGHT IMAGE

AUTOMATIC SWITCHING AT REGULAR INTERVALS OF TIME

MALDI MASS SPECTROMETER AND STORAGE MEDIUM RECORDING PROGRAM FOR MALDI MASS SPECTROMETER

TECHNICAL FIELD

The present invention relates to a MALDI mass spectrometer using an ion source employing matrix assisted laser desorption/ionization (MALDI) as well as a storage medium recording a computer program for a MALDI mass spectrometer.

BACKGROUND ART

In a MALDI mass spectrometer, a sample prepared by mixing a specimen to be analyzed with an ionization-assisting agent called the matrix is irradiated with laser light for a short period of time to turn the components of the specimen in the sample into ions while vaporizing those components. The ions derived from the components of the specimen in this manner are subsequently introduced, for example, into an ion trap mass separator or time-of-flight mass separator in the MALDI mass spectrometer to separate those ions according to their mass-to-charge ratios m/z and individually detect the separated ions.

The ion source in a MALDI mass spectrometer normally includes a plate-shaped metallic sample plate, which has a plurality of wells formed on its top surface, allowing one sample to be prepared in each well. The most basic method for preparing a sample includes the steps of dropping a mixed liquid of a solution of the specimen to be analyzed and a matrix solution into a well of a sample plate, and drying that liquid. As another sample preparation method, the step of mixing the solution of the specimen with the matrix solution may be performed on a well of the sample plate.

A sample prepared in this manner is not always formed at the center of the well, which has a circular shape as viewed from above. In some cases, the sample may be formed at a position that is within the well yet displaced from the center. Furthermore, even when the sample is formed at or near the center of the well, the optimum measurement point ("sweet spot") at which the most satisfactory signal (normally, the highest level of signal intensity) is obtained by irradiation with laser light is not always at the center of the well since the distribution of the matrix crystal is non-uniform. To deal with such a situation, in an analysis using a MALDI mass spectrometer, an operator often performs necessary tasks, such as the determination of the point that should be irradiated with laser light while visually observing the location of the sample formed on the sample plate or distribution of the matrix crystal.

In order to facilitate the task of determining the laser irradiation point, a MALDI mass spectrometer described in Patent Literature 1 illuminates the sample plate with light within an ultraviolet wavelength region and detects the reflected light from the top surface of the sample plate to create an observation image of the sample plate and display it on a screen of a display unit. When a matrix that absorbs light within the ultraviolet wavelength region is used, the method can produce an observation image which clearly shows the sites where the matrix is distributed. This image allows for an effortless check of the position of the adhered sample on the sample plate, state of distribution of the matrix and other related conditions.

CITATION LIST

Patent Literature

Patent Literature 1: JP 2018-36100 A

Non Patent Literature

Non Patent Literature 1: "MALDImini™-1 Digital Ion Trap Mass Spectrometer", disclosed on Shimadzu Corporation's website, [accessed on Jan. 14, 2020]

SUMMARY OF INVENTION

Technical Problem

However, depending on the kind of matrix, state of the mixture of the matrix and the specimen or other relevant factors, illuminating the sample plate with visible light rather than ultraviolet light may make it easier to check the state of adhesion of the sample. Furthermore, some operators may be accustomed to watching an observation image obtained by illuminating the sample plate with visible light, in which case using such a type of image may allow for a more appropriate judgment. Additionally, two or more kinds of samples respectively prepared using different kinds of matrices may be present in the plurality of wells provided on one sample plate, in which case the check of the state of adhesion of the sample may be satisfactorily performed for only some of the samples by the conventional MALDI mass spectrometer mentioned earlier The present invention has been developed in view of such problems. Its objective is to provide a MALDI mass spectrometer which allows an operator to properly check the state of adhesion of the sample, state of distribution of the matrix and other related conditions, as well as a storage medium recording a computer program for such a MALDI mass spectrometer.

Solution to Problem

One mode of the MALDI mass spectrometer according to the present invention developed for solving the previously described problem is a MALDI mass spectrometer configured to irradiate a sample on a sample plate with laser light to ionize a component in the sample and perform a mass spectrometric analysis of the component, the MALDI mass spectrometer including:

a plurality of light source units each of which is configured to emit a beam of light with a different wavelength region;

an illumination light switching section configured to selectively cast one of the beams of light emitted from the plurality of light source units, onto the sample plate as illumination light; and an imaging section configured to acquire an optical image of the sample plate formed by the illumination light, the imaging section being common to the plurality of light source units.

One mode of the storage medium recording a program for a MALDI mass spectrometer according to the present invention developed for solving the previously described problem is a computer readable storage medium recording a computer program to be used for a MALDI mass spectrometer configured to irradiate a sample on a sample plate with laser light to ionize a component in the sample and perform a mass spectrometric analysis of the component, the MALDI mass spectrometer further configured to selectively cast one of a plurality of beams of light emitted from a plurality of light source units each of which is configured to emit a beam of light with a different wavelength region, onto the sample plate as illumination light, and acquire, with an imaging section, an optical image of the sample plate formed by the illumination light, and the computer program configured to make a computer function as:

a display-processing functional section configured to display, on a screen of the same display unit, a plurality of observation images acquired for the sample plate in which one of the observation images is displayed as a real-time image continuously updated with the passage of time and another one of the observation images is displayed as a snap image which is a still image acquired at a predetermined point in time; and an illumination-light-switching control functional section configured to control a switching operation of the illumination light so that a beam of light emitted from a specific light source unit among the plurality of light source units is cast onto the sample plate as the illumination light when the real-time image is being updated, and a beam of light emitted from a light source unit different from the specific light source unit among the plurality of light source units is cast onto the sample plate as the illumination light at the predetermined point in time specified for acquiring the snap image.

Advantageous Effects of Invention

In one mode of the MALDI mass spectrometer according to the present invention, the switching of the illumination light by the illumination light switching section may be performed by turn-on and turn-off operations through the drive control of the light source units. Another possibility is to maintain all light source units in the ON state and select the illumination light to be allowed to reach the sample plate, for example, by switching or blocking an optical path using a mirror, shutter or other optical elements.

The previously described mode of the MALDI mass spectrometer according to the present invention can acquire, for example, two observation images of the same sample plate, with one image showing the sample plate illuminated with light within the visible wavelength region and the other image showing the sample plate illuminated with light within the ultraviolet wavelength region, and simultaneously display both images or selectively display one of those images. Thus, the previously described mode of the MALDI mass spectrometer according to the present invention can more properly show the user the position of the sample formed on the sample plate, state of distribution of the matrix and other related conditions, thereby allowing the user to easily locate, for example, a sweet spot at which a high level signal intensity can be obtained in the sample.

The previously described mode of the storage medium recording a program for a MALDI mass spectrometer according to the present invention enables a computer to simultaneously display, on the screen of the display unit, two observation images of the same sample plate including, for example, one image showing the sample plate illuminated with light within the visible wavelength region and the other image showing the sample plate illuminated with light within the ultraviolet wavelength region. One of the observation images is a real-time image, in which the imaging range on the sample plate changes its position in real time when the position of the sample plate is changed. This allows the user to visually check the observation image of each of the samples at different positions on the sample plate or each of the different sites in the same sample. The other observation image is a snap image, which allows the user to visually check the observation image reflecting the state of a sample on the sample plate observed at the predetermined point in time, despite the change in the position of the sample plate. Thus, by using the previously described mode of the storage medium recording a program for a MALDI mass spectrometer according to the present invention, the user can more properly and efficiently check the position of the sample formed on the sample plate, state of distribution of the matrix, and other related conditions even in the case where, for example, the kind of matrix used for the preparation of the sample changes from one well to another on the sample plate.

DESCRIPTION OF EMBODIMENTS

A MALDI-MS system, which is one embodiment of the MALDI mass spectrometer according to the present invention, is hereinafter described with reference to the attached drawings.

Figure 1:
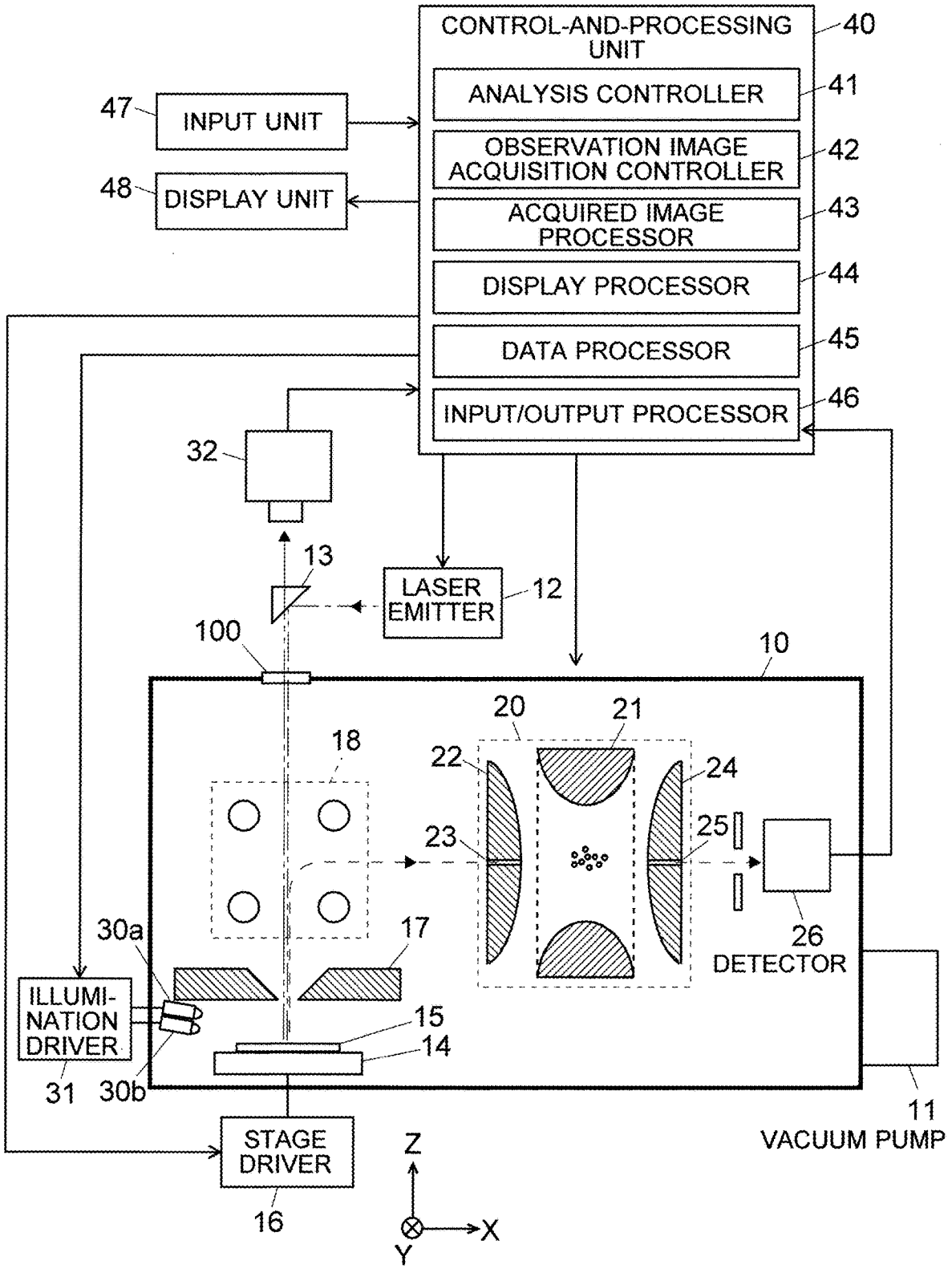
FIG. 1 is a configuration diagram showing the main components of a MALDI-MS system as one embodiment of the present invention.

FIG. 1 is a configuration diagram showing the main components of the MALDI-MS system according to the present embodiment. This MALDI-MS system is a system using a MALDI ion source as the ion source and an ion trap mass separator as the mass separator, as disclosed in Non Patent Literature 1.

As shown in FIG. 1, a box-shaped vacuum chamber 10 evacuated by a vacuum pump 11 contains a sample stage 14, on which a sample plate 15 is to be placed, as well as an extraction electrode 17, quadrupole deflector 18, ion trap 20 and detector 26. A transparent window 100 is provided in the wall (ceiling) of the vacuum chamber 10 directly above the sample stage 14. A laser emitter 12, half mirror 13 and visible light camera 32 are arranged in an area above the top wall of the vacuum chamber 10. Three axes X, Y and Z orthogonal to each other are defined as shown in FIG. 1 for convenience of the indication of the positional relationship of those components. The X-Y plane is normally a plane parallel to the installation surface of the system. The surface on which the sample plate 15 is to be placed in the sample stage 14 is also parallel to the X-Y plane.

The quadrupole deflector 18 is composed of four rod electrodes extending in the Y-axis direction. Direct voltages are respectively applied from a power source (not shown) to the rod electrodes to form a deflecting electric field which bends the direction of travel of the ions within the space surrounded by those rod electrodes. The ion trap 20 has the configuration of a three-dimensional quadrupole including a substantially ring-shaped electrode 21 as well as a pair of end-cap electrodes 22 and 24 facing each other across the ring electrode 21. An ion injection hole 23 is formed in the entrance end-cap electrode 22 located on the side facing the quadrupole deflector 18, while an ion ejection hole 25 is formed in the exit end-cap electrode 24. Predetermined voltages are applied from a power source (not shown) to the ring electrode 21 as well as the end-cap electrodes 22 and 24, respectively, whereby ions can be captured within the space surrounded by those electrodes or ejected from the same space to the outside through the ion ejection hole 25.

The sample stage 14 is movable in the two axial directions of the X and Y axes by a stage driver 16 including a motor. A visible light source 30*a* and ultraviolet light source 30*b* for illuminating the top surface of the sample plate 15 are provided within the space between the sample stage 14 and the extraction electrode 17. An illumination driver 31 is provided for turning on the two light sources 30*a* and 30*b*.

The control-and-processing unit 40 includes, as its functional blocks, an analysis controller 41, observation image acquisition controller 42, acquired image processor 43, display processor 44, data processor 45, input/output processor 45 and other necessary components. An input unit 47 and a display unit 48 serving as a user interface are connected to the control-and-processing unit 40.

The analysis controller 41 acts as the main controller which operates related sections for executing an analysis. The observation image acquisition controller 42 controls related sections for displaying an observation image of the top surface of the sample plate 15, as will be described later. The acquired image processor 43 processes image data obtained from the visible light camera 32 to create an observation image. The input/output processor 46 is responsible for the input/output operation using the input unit 47 and the display unit 48. The display processor 44 creates information to be displayed on the screen of the display unit 48, and displays the information via the input/output processor 46. The data processor 45 receives detection data from the detector 26 and processes the data for specific purposes, such as the creation of a mass spectrum.

In normal cases, the control-and-processing unit 40 is actually a personal computer, workstation or similar type of computer, with the aforementioned functional blocks and other components embodied by executing, on the computer, dedicated software (computer program) installed on the same computer. In that case, the input unit 47 includes a keyboard and a pointing device provided for the computer, while the display unit 48 includes a display monitor. The aforementioned computer program can be offered to users in the form of a non-transitory storage medium recording the program, such as a CD-ROM, DVD-ROM, memory card, or USB memory (dongle). It may also be offered to users in the form of data transferred through the Internet or similar communication networks.

An operation for performing a mass spectrometric analysis on samples formed on the sample plate 15 in the MALDI-MS system according to the present embodiment is hereinafter schematically described.

Figure 2:
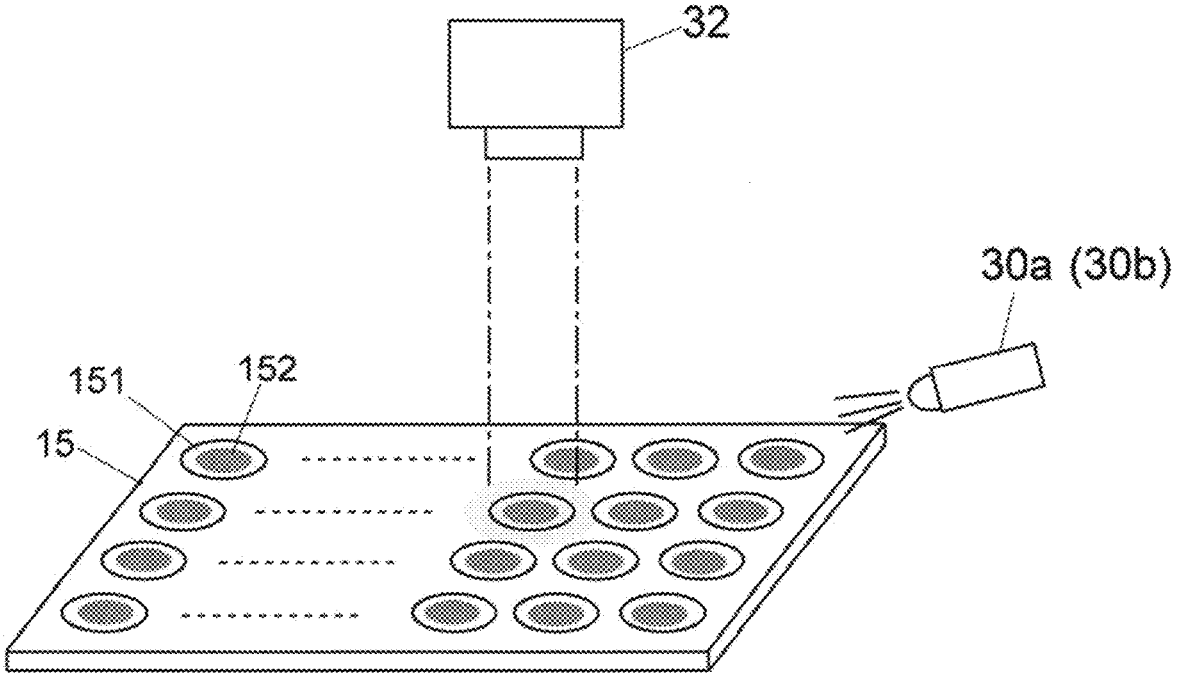
FIG. 2 is a model diagram showing a situation in which the top surface of a sample plate is being imaged in the MALDI-MS system according to the present embodiment.

As shown in FIG. 2, the plate-shaped sample plate 15 made of metal (normally, stainless steel) has a top surface on which a plurality of wells 151, each of which has a circular shape as viewed from above, are formed. One sample 152, which is a mixture of a specimen and a matrix, is formed within each well 151. There is no specific limitation on the method for preparing the samples 152.

With the sample plate 15 placed on the sample stage 14 and the vacuum chamber 10 evacuated with the vacuum pump 11, the laser emitter 12 under the control of the analysis controller 41 generates laser light in a pulsed form. The laser light is reflected by the half mirror 13 and passes through the window 100, to be delivered to a sample on the sample plate 15 in a substantially perpendicular direction. As noted earlier, the sample stage 14 can be moved in the X and Y directions by the stage driver 16. By this movement, the point of irradiation with the laser light can be adjusted.

Upon being irradiated with the laser light for ionization, the components of the specimen in the sample are ionized. The thereby produced ions are extracted from the vicinity of the sample plate 15 by the electric field created by the extraction electrode 17, and travel in a roughly Z-axis direction to arrive at the quadrupole deflector 18. The ions have their traveling path bent by approximately 90 degrees due to the deflecting electric field created by the quadrupole deflector 18, and travel in a roughly X-axis direction. The ions subsequently pass through the ion injection hole 23 and enters the ion trap 20, to be captured by an electric field created by a radio-frequency voltage applied to the ring electrode 21.

Ions generated from a sample by a single laser-light irradiation are temporarily captured within the ion trap 20, and subsequently ejected through the ion ejection hole 25 in ascending or descending order of their mass-to-charge ratio by an electric field created by the voltages applied to the end-cap electrodes 22 and 24. For the ejection of the ions from the ion trap 20, the technique of resonant excitation in which an ion having a specific mass-to-charge ratio is made to significantly oscillate can be used.

The detector 26 sequentially detects the ions ejected from the ion trap 20 and produces a detection signal corresponding to the amount of ions it has received. The data processor 45 receives this detection signal, converts it into digital data, and creates a mass spectrum representing the relationship between mass-to-charge ratio and signal intensity. It should be noted that the MALDI method normally has a comparatively large variation in the amount of ions generated by a single laser-light irradiation. Therefore, in order to improve the accuracy and sensitivity of the analysis, the same sample is irradiated with the laser light multiple times, and the mass spectrum data acquired for each laser-light irradiation are accumulated to obtain a final mass spectrum which is less affected by the variation in the amount of generated ions and other unfavorable factors.

For the previously described analysis, the task of determining the point of irradiation with the laser light in the sample in advance of the analysis is performed by the user (operator) as follows: An observation image showing an enlarged view of a sample on the sample plate 15 is displayed on the screen of the display unit 48. Watching the observation image, the operator inputs instructions from the input unit 47 to appropriately change the position of the sample stage 14 to ascertain which position in the sample is appropriate for the analysis. In this task, the operator refers to an observation image of the top surface of the sample plate 15 displayed on the screen of the display unit 48. An operation for displaying this reference image is hereinafter described in detail.

The visible light source 30*a* is a visible LED which emits light within the visible wavelength region. The ultraviolet light source 30*b* is an ultraviolet LED which emits light within the ultraviolet wavelength region. In the present example, this LED emits light within an ultraviolet wavelength region centered on 350 nm. Examples of the matrices used for MALDI include DHB (2,5-dihydroxybenzoic acid) and CHCA (α-cyano-4-hydroxycinnamic acid). DHB has the maximum absorption wavelength around 330 nm, while CHCA has the maximum absorption wavelength around 341 nm. The difference between the peak emission wavelength in the emission wavelength distribution of the ultraviolet light source 30*b* and the maximum absorption wavelengths of those matrices is as small as 20 nm. Those wavelength bands overlap each other to a considerable extent. In this manner, the wavelength band of the ultraviolet light source 30*b* is selected so that it will sufficiently overlap the absorption wavelength band of the matrix to be used.

As shown in FIG. 2, the top surface of the sample plate 15 is illuminated with either visible or ultraviolet light which is cast obliquely from above. For example, when the sample plate 15 is illuminated with the visible light, the light is almost entirely reflected by the top surface of the sample plate 15 inclusive of the samples 152 since the matrix in the samples 152 does not significantly absorb visible light. The reflected light enters the visible light camera 32. Therefore, with the visible light camera 32, an observed image can be obtained in which important objects on the top surface of the sample plate 15, such as the marks indicating the position of the wells 151, can be satisfactorily observed.

On the other hand, when the sample plate 15 is illuminated with the ultraviolet light, the matrix in the samples 152 significantly absorbs ultraviolet light around the specific absorption wavelength band, and emits fluorescent light within the visible wavelength band. Meanwhile, the ultraviolet light hitting the top surface of the sample plate 15 where no sample 152 is present is almost entirely scattered without undergoing absorption. The visible light camera 32, which is configured to mainly detect visible light, produces an observation image in which the sites where the matrix is present can be brightly seen. Thus, two evidently different observation images are obtained for the same imaging range by using the ultraviolet light and the visible light as the illumination light.

Figure 4A:
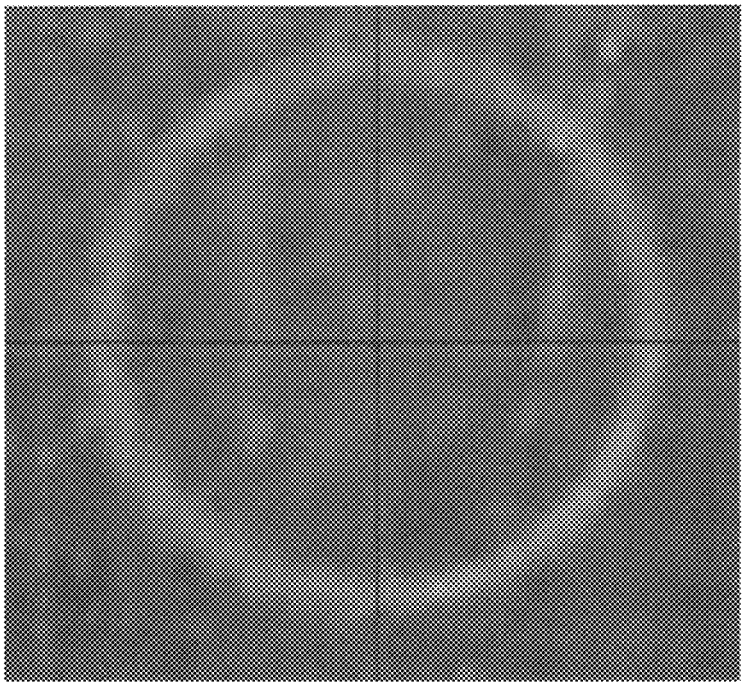
FIGS. 4A and 4B show one example of a visible-light image and an ultraviolet-light image in the MALDI-MS system according to the present embodiment.
Figure 4B:
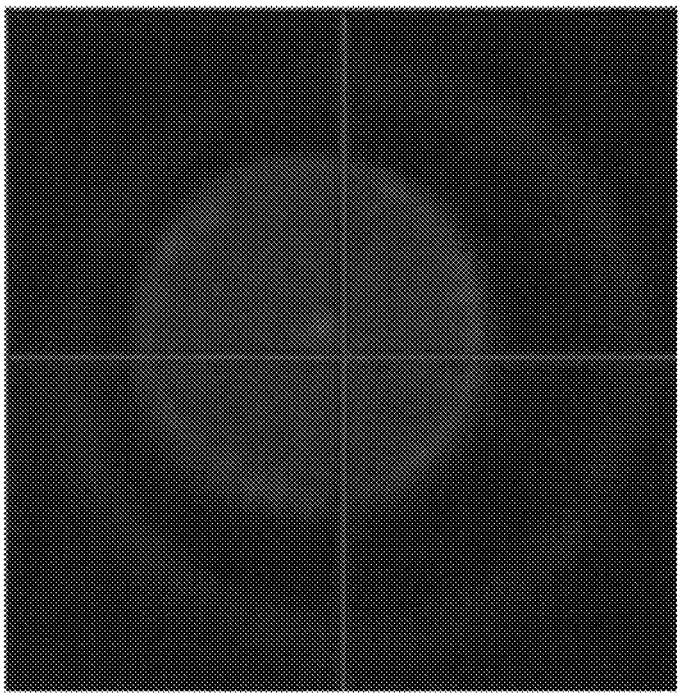

FIGS. 4A and 4B show one example of the visible-light image (an optical image acquired by using the visible light for the illumination) and the ultraviolet-light image (an optical image acquired by using the ultraviolet light for the illumination) corresponding to one well, taken with the visible light camera 32. In the visible-light image shown in FIG. 4A, the ring-shaped mark indicating the position of the well is clearly visible, whereas the sample portion is unclear. By contrast, in the ultraviolet-light image shown in FIG. 4B, the sample portion is clearly visible, in which the sites where the matrix is abundantly present look particularly white. With this image, the state of distribution of the matrix can be satisfactorily recognized.

The cross hairs shown in FIGS. 4A and 4B are a marker whose point of intersection indicates the point of irradiation with the laser light for ionization. From this marker and the observation images, the operator can recognize the laser irradiation point in the sample at that point in time.

In the MALDI-MS system according to the present embodiment, one of the following display modes can be used for displaying observation images on the screen of the display unit 48.

<First Display Mode>

Figure 5A:
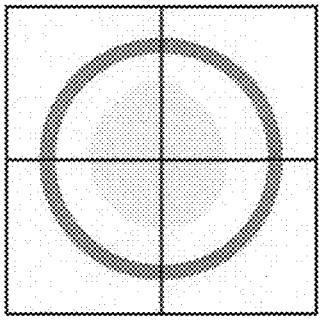
FIGS. 5A and 5B show one example of the transition between two observation images in the MALDI-MS system according to the present embodiment.
Figure 5B:
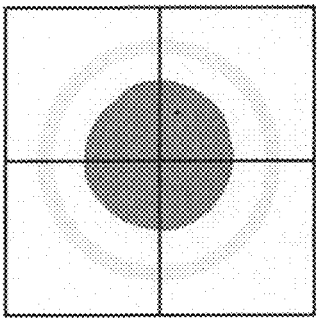

FIGS. 5A and 5B illustrate the transition of the display image in the first display mode.

In this display mode, the observation image acquisition controller 42 displays, via the input/output processor 48, a screen on the display unit 48 which allows users to select either the visible light or ultraviolet light as the illumination light. On this display, the operator selects either the visible light or ultraviolet light. Upon receiving the selecting instruction via the input/output processor 46, the observation image acquisition controller 42 controls the illumination driver 31 to turn on either the light source 30*a* or 30*b* corresponding to the visible or ultraviolet light selected. Either light source 30*a* or 30*b* is thereby turned on, and the light emitted from the light source illuminates the top surface of the sample plate 15.

The visible light camera 32 acquires an optical image of the top surface of the sample plate 15 through the half mirror 13, window 100, and opening of the extraction electrode 17. The image data acquired with the visible light camera 32 is sent to the acquired image processor 43, which performs predetermined image processing to create an observation image for display. The display processor 44 shows the created observation image at a predetermined position on the screen of the display unit 48. Accordingly, if the operator has selected the visible light as the light to be used for illumination, a visible-light image as shown in FIG. 5A is displayed. If the operator has selected the ultraviolet light as the light to be used for illumination, an ultraviolet-light image as shown in FIG. 5B is displayed. FIGS. 5A and 5B are images corresponding to the FIGS. 4A and 4B mentioned earlier, for example.

The operator can switch the selection between the visible light and ultraviolet light by using the input unit 47. According to the switching instruction, the observation image acquisition controller 42 switches the light source that should be turned on. Accordingly, the observation image displayed on the screen of the display unit 48 is also switched between the visible-light and ultraviolet-light images. The observation image displayed in this situation is a real-time image showing a view of the top surface of the sample plate 15 in real time. Therefore, for example, when the operator changes the position of the sample stage 14 in the X-Y plane by an operation using the input unit 47, the range of the displayed observation image also correspondingly changes its position. In this manner, the operator can select an observation image which is easier for the operator to watch, or one which the operator is accustomed to watching, to determine the point to be irradiated with laser light.

<Second Display Mode>

Figure 6A:
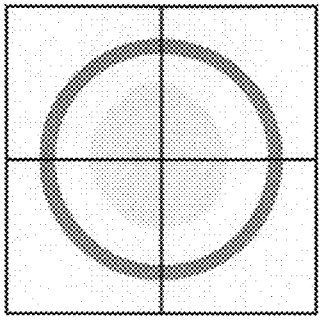
FIGS. 6A and 6B show another example of the transition between two observation images in the MALDI-MS system according to the present embodiment.
Figure 6B:
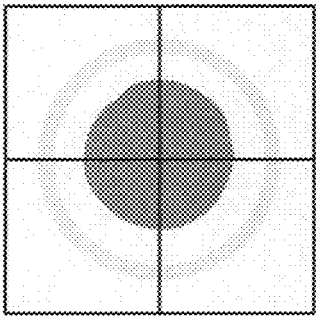

FIGS. 6A and 6B illustrate the transition of the display image in the second display mode which is different from the first display mode.

In the present display mode, the observation image acquisition controller 42 controls the illumination driver 31 so that the visible light source 30*a* and the ultraviolet light source 30*b* are alternately turned on at predetermined intervals of time. Accordingly, the light emitted from the visible light source 30*a* and the one emitted from the ultraviolet light source 30*b* alternately illuminate the top surface of the sample plate 15 at predetermined intervals of time.

The image data acquired with the visible light camera 32 for the illumination light is sent to and processed by the acquired image processor 43. The display processor 44 displays the created observation image within the screen of the display unit 48. Accordingly, a visible-light image as shown in FIG. 6A and an ultraviolet-light image as shown in FIG. 6B are automatically and alternately displayed on the screen of the display unit 48. As in the first display mode, the observation image displayed in this manner is a real-time image of the top surface of the sample plate 15. Therefore, the operator can determine the point to be irradiated with laser light while visually checking both the visible-light and ultraviolet-light images in real time.

<Third Display Mode>

Figure 3:
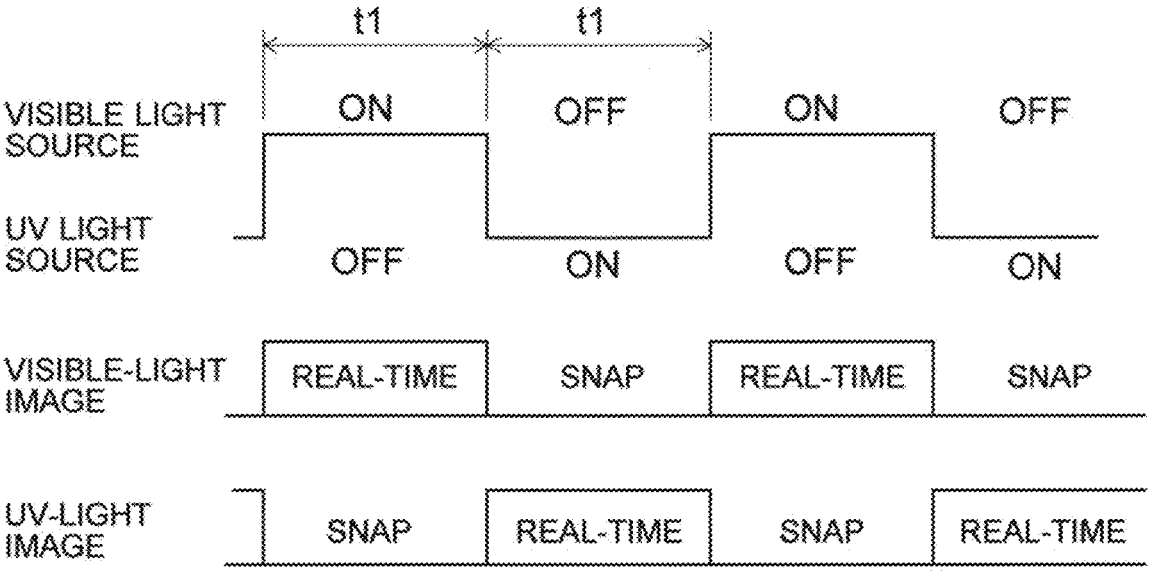
FIG. 3 is a schematic timing chart showing the on/off operation of light sources and an imaging operation in the MALDI-MS system according to the present embodiment.
Figure 7A:
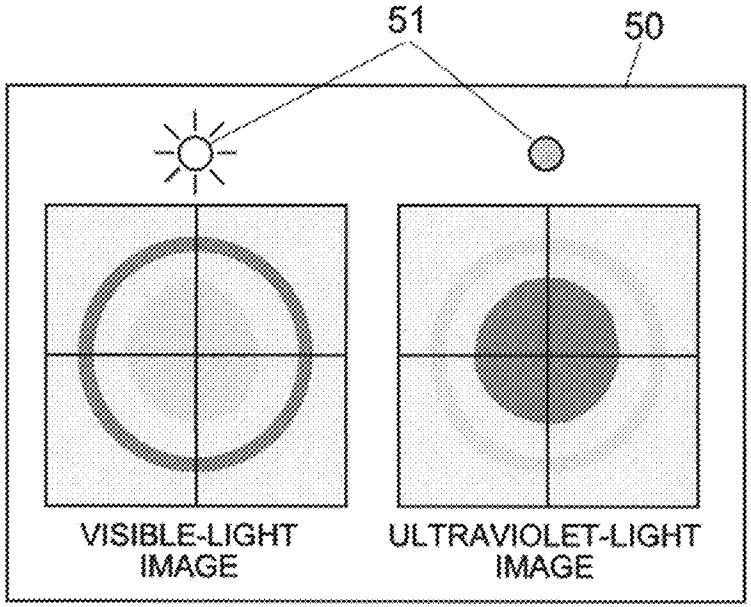
FIGS. 7A and 7B show still another example of the transition between two observation images in the MALDI-MS system according to the present embodiment.
Figure 7B:
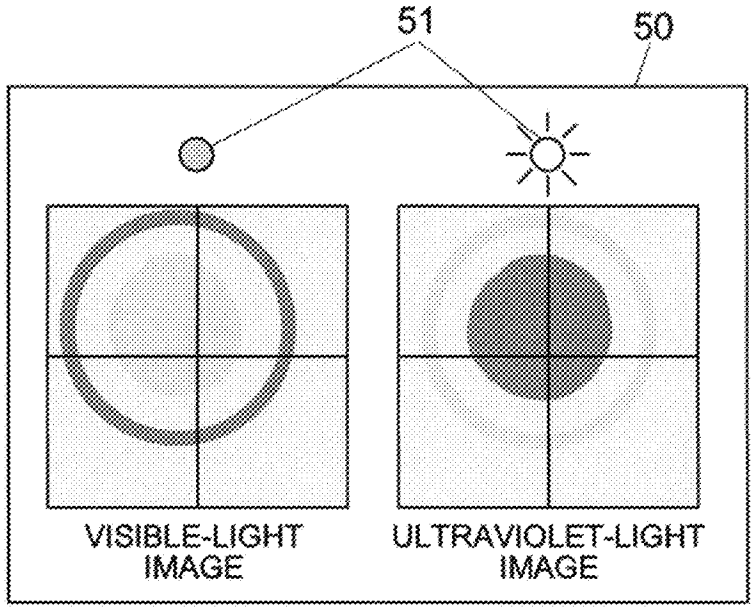

FIGS. 7A and 7B illustrate the transition of the display image in the third display mode which is different from the first and second display modes. FIG. 3 is a schematic timing chart showing the turn-on/off operation of the light sources 30*a* and 30*b* as well as an imaging operation in the third display mode.

In the third display mode, as in the second display mode, the observation image acquisition controller 42 controls the illumination driver 31 so that the visible light source 30*a* and the ultraviolet light source 30*b* are alternately turned on at predetermined intervals of time t1 (see FIG. 3). Accordingly, the light emitted from the visible light source 30*a* and the one emitted from the ultraviolet light source 30*b* alternately illuminate the top surface of the sample plate 15 at predetermined intervals of time t1.

The image data acquired with the visible light camera 32 for the illumination light is sent to and processed by the acquired image processor 43. The display processor 44 displays the created observation image within the screen of the display unit 48. In the third display mode, as shown in FIGS. 7A and 7B, the display processor 44 displays an image display frame 50 within the screen of the display unit 48, with the two observation images, i.e., the visible-light and ultraviolet-light images, horizontally arranged. An indicator 51 which turns on and off is provided above each of the visible-light and ultraviolet-light images in the image display frame 50.

As shown in FIG. 3, while the visible light is illuminating the top surface of the sample plate 15, the visible light camera 32 acquires a visible-light image of the top surface of the sample plate 15. This visible-light image is a real-time image. The display processor 44 displays, in the left area of the image display frame 50, the visible-light image acquired in real time under illumination with the visible light, as well as turns on the indicator 51 above the same image (see FIG. 7A). This indicator 51 shows that the image is the real-time image.

After completion of the turn-on period for the visible light source 30*a*, the light source that should be turned on is switched from the visible light source 30*a* to the ultraviolet light source 30*b*, whereupon the ultraviolet light begins to illuminate the top surface of the sample plate 15. In this situation, the visible light camera 32 acquires an ultraviolet-light image of the top surface of the sample plate 15 as the real-time image. The display processor 44 displays, in the right area of the image display frame 50, the ultraviolet-light image acquired in real time under illumination with the ultraviolet light, as well as turns on the indicator 51 above the same image. Meanwhile, the display processor 44 creates a snap image, or a still image, from the visible-light image which has been displayed as the real-time image immediately before the switching of the light source from the visible light source 30*a* to the ultraviolet light source 30*b*, and continues displaying the snap image in the left area of the image display frame 50. Understandably, this snap image displayed in the left area of the image display frame 50 is no longer a real-time image, so that the indicator 51 above the same image is turned off (see FIG. 7B).

The display processor 44 performs the previously described processing every time the light source that should be turned on is switched from the visible light source 30*a* to the ultraviolet light source 30*b* or vice versa. Accordingly, as shown in FIGS. 7A and 7B, the real-time image and the snap image are interchanged with each other between the visible-light and ultraviolet-light images every time the light source that should be turned on is switched at regular intervals of time t1, with the indicator 51 above the real-time image turned on and the indicator 51 above the snap image turned off. As described earlier, for example, when the operator changes the position of the sample stage 14 in the X-Y plane by an operation using the input unit 47, the range of the observation image displayed on the real-time image also correspondingly changes, whereas the range of the observation image displayed on the snap image is fixed.

The third display mode allows an operator to determine an appropriate point to be irradiated with the laser light while comparing the visible-light and ultraviolet-light images displayed side by side.

<Fourth Display Mode>

Figure 8A:
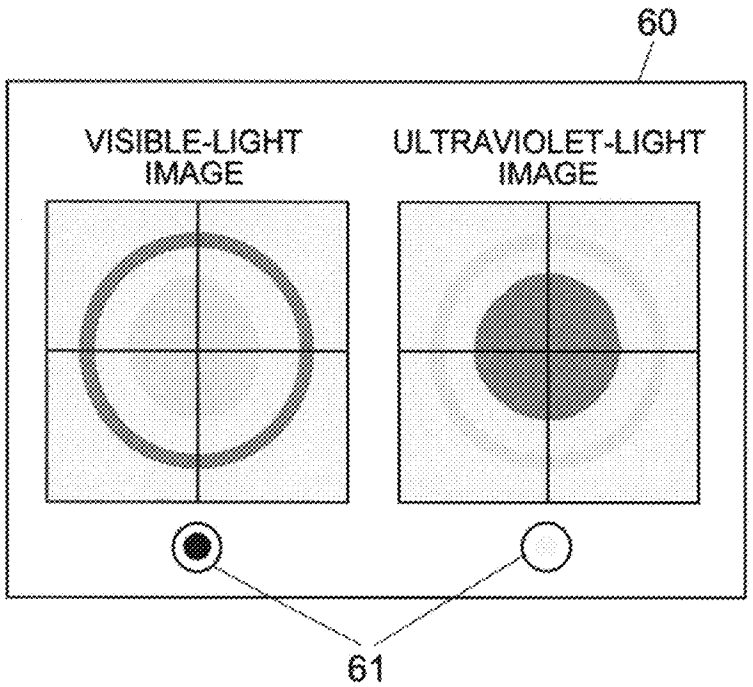
FIGS. 8A and 8B show still another example of the transition between two observation images in the MALDI-MS system according to the present embodiment.
Figure 8A:
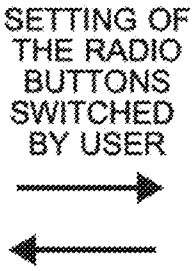
Figure 8B:
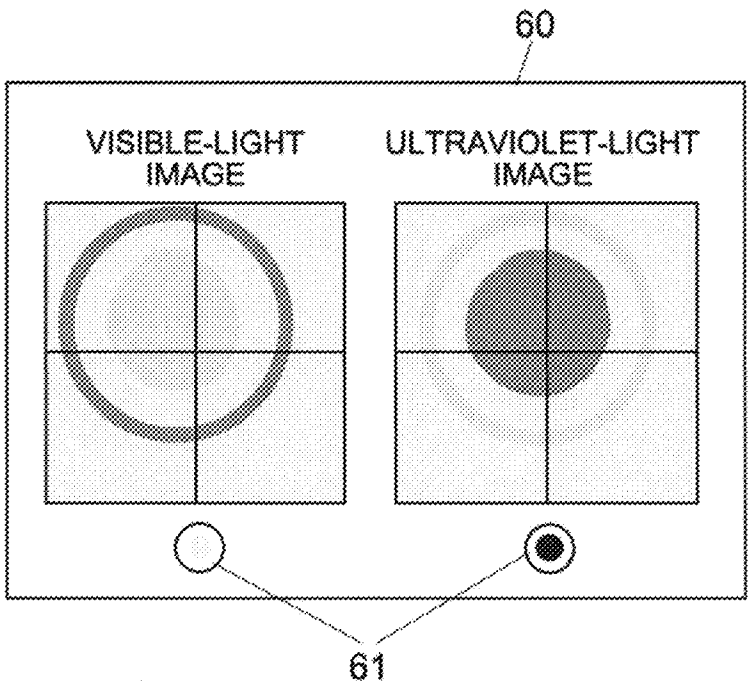

FIGS. 8A and 8B illustrate the transition of the display image in the fourth display mode which is different from the first through third display modes.

In the fourth display mode, as in the third display mode, the visible-light and ultraviolet-light images are displayed side by side within an image display frame 60. However, unlike the third display mode in which the used light source is automatically switched at regular intervals of time, the present mode allows the operator to perform an operation using the input unit 47 to select which of the visible and ultraviolet light sources 30*a* and 30*b* should be used, as in the first display mode. In the present case, as shown in FIGS. 8A and 8B, radio buttons 61 for selecting the visible or ultraviolet light are provided within the image display frame 60. By clicking one of those radio buttons 61, the operator can select the light source to be used. The observation image corresponding to the selected light source will be the real-time image.

After the light source to be used has been switched by the operator, for example, from the visible light source 30*a* to the ultraviolet light source 30*b* (from FIG. 8A to FIG. 8B), the visible light image which was displayed in real time immediately before the switching is maintained on the display as a snap image. Accordingly, after the switching operation, the visible-light image as the snap image and the ultraviolet-light image as the real-time image are displayed side by side within the image display frame 60.

In order to sequentially perform measurements for a plurality of wells 151 on the sample plate 15, the MALDI-MS system according to the present embodiment is provided with the function of automatically driving the sample stage 14 so that the laser irradiation point will be automatically set at or near the center of the next well 151 in a predetermined order, i.e., so that the next well 151 to be subjected to the measurement will come into the imaging range. When the imaging range has been automatically moved to the next well 15 in this manner, the light source is temporarily switched to the one that is not the selected light source at that point in time, and the observation image of the top surface of the sample plate 15 immediately after the movement is taken as the snap image. When a new snap image has been obtained in this manner, the display processor 44 updates the snap image displayed within the image display frame 60 with the new observation image. Accordingly, for example, even under the condition that the light source currently selected for the illumination is the visible light source 30*a*, when the imaging range has automatically been moved to the next well 151, the ultraviolet-light image, which is currently displayed as the snap image, will be updated with the latest snap image acquired after the movement. This operation prevents the situation in which an image displayed as the snap image shows a well that is not the well which the operator is observing in the real-time image.

The fourth display mode allows an operator to select, as the real-time image, an observation image which is easier for the operator to watch, or one which the operator is accustomed to watching, and to determine the laser irradiation point while comparing the visible-light and ultraviolet-light images displayed side by side.

The system may be configured so that, when the operator performs an operation for changing the position of the sample stage 14 in order to change the laser irradiation point, the cross-hairs mark indicating the laser irradiation point changes its position on the snap image so that it correctly indicates the laser irradiation point at that point in time, while the imaging range in the snap image remains unchanged. This configuration allows the operator to correctly recognize the laser irradiation point not only on the real-time image but also on the snap image, thereby avoiding a false recognition of the laser irradiation point.

<Fifth Display Mode>

Figure 9A:
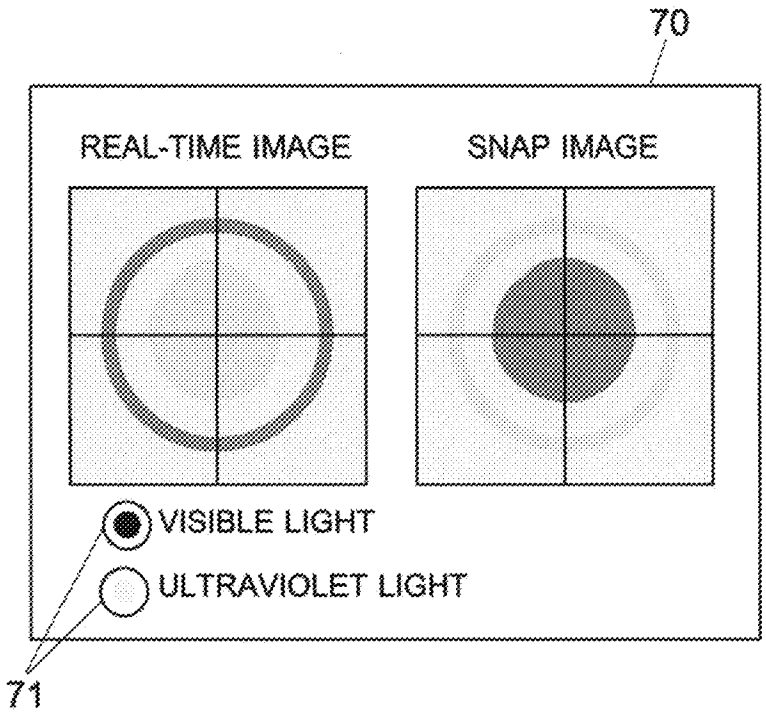
FIGS. 9A and 9B show still another example of the transition between two observation images in the MALDI-MS system according to the present embodiment.
Figure 9A:
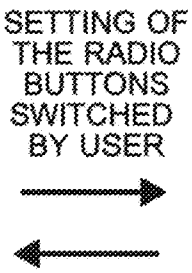
Figure 9B:
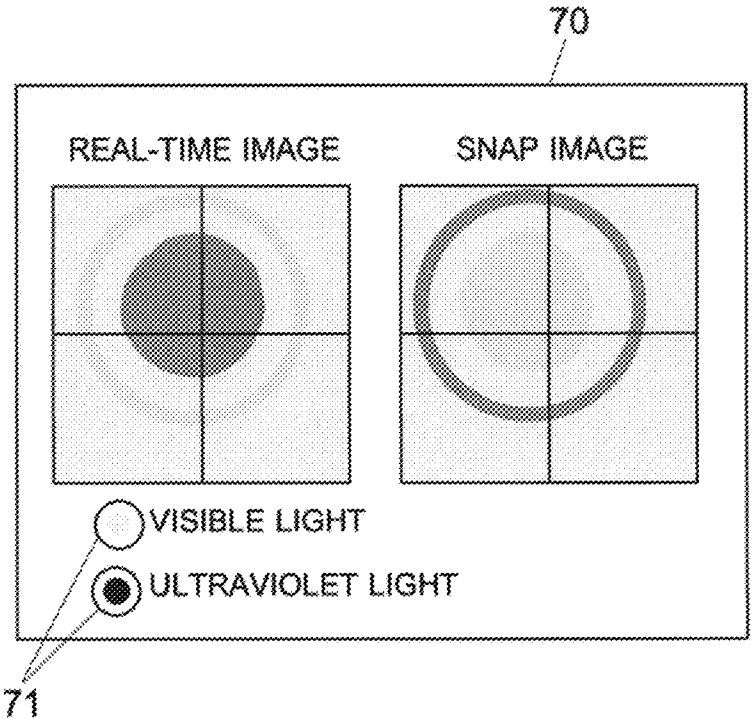

FIGS. 9A and 9B illustrate the transition of the display image in the fifth display mode which is different from the first through fourth display modes.

In the third and fourth display modes, the visible-light and ultraviolet-light images are displayed at their respectively designated positions within the image display frame. In the fifth display mode, it is the real-time image and the snap image that have their display positions fixed, with the real-time image on the left side and the snap image on the right side within the image display frame 70. When visible light is selected with a visible/ultraviolet light selection radio buttons 71 as shown in FIG. 9A, the visible-light image is displayed as the real-time image on the left side, while the ultraviolet-light image is displayed as the snap image on the right side. When ultraviolet light is selected with the visible/ultraviolet light selection radio buttons 71 as shown in FIG. 9B, the ultraviolet-light image is displayed as the real-time image on the left side, while the visible-light image is displayed as the snap image on the right side.

As for the snap image, a real-time image displayed immediately before the switching of the light source, or an image acquired immediately after an automatic movement of the imaging range to the next well, can be used, as in the fourth display mode.

The fifth display mode allows an operator to select, as the real-time image, an observation image which is easier for the operator to watch, or one which the operator is accustomed to watching, and to determine an appropriate laser irradiation point by additionally referring to the snap image as needed while continuously watching the real-time image.

As in the case of the fourth display mode, the system in the fifth display mode may be configured so that the cross-hairs mark indicating the laser irradiation point changes its position on the snap image so that it correctly indicates the laser irradiation point at that point in time. This configuration allows the operator to correctly recognize the laser irradiation point also on the snap image, thereby avoiding a false recognition of the laser irradiation point.

Although the two observation images are horizontally arranged within the image display frame in any of the third through fifth display modes, it is naturally possible to vertically arrange them. It is also possible to superpose the visible-light and ultraviolet-light images on each other on the display, with their relative position adjusted so that the same site on the top surface of the sample plate 15 comes to the same position in both images, instead of arranging them horizontally or vertically.

In the MALDI-MS system according to the previously described embodiment, two types of light sources, i.e., the visible and ultraviolet light sources, are used. It is also possible to use three or more light sources. The use of both visible and ultraviolet light sources is not indispensable; it is possible to use two or more types of light sources all of which emit light within the ultraviolet wavelength region, with their wavelength bands shifted from each other (without completely overlapping each other). A light source which emits light within an infrared, near-infrared or other wavelength bands may be used in place of the ultraviolet light source. What wavelength band should be used for the illumination can be determined according to the absorption wavelength band of the used matrix. Accordingly, in the case where a plurality of kinds of matrices are used for the plurality of samples formed on one sample plate 15, a light source with an appropriate wavelength band should preferably be used for each matrix.

In the MALDI-MS system according to the previously described embodiment, the switching of the illumination light to be cast onto the sample plate 15 is achieved by turning on/off the light sources. As another example, the switching of the illumination light to be cast onto the sample plate 15 may be achieved by switching an optical path using a mechanically movable mirror, a shutter, or other types of optical elements.

Although an ion trap is used as the mass separator in the MALDI-MS system according to the previously described embodiment, there is actually no limitation on the type of mass separator or method of mass separation as long as the ion source is a MALDI ion source (including an atmospheric pressure MALDI ion source). Accordingly, for example, the present invention can be applied in a MALDI-TOFMS using a time-of-flight mass separator for mass separation.

[Various Modes of Invention]

A person skilled in the art can understand that the previously described illustrative embodiments are specific examples of the following modes of the present invention.

(Clause 1) One mode of the MALDI mass spectrometer according to the present invention is a MALDI mass spectrometer configured to irradiate a sample on a sample plate with laser light to ionize a component in the sample and perform a mass spectrometric analysis of the component, the MALDI mass spectrometer including:

a plurality of light source units each of which is configured to emit a beam of light with a different wavelength region;

an illumination light switching section configured to selectively cast one of the beams of light emitted from the plurality of light source units, onto the sample plate as illumination light; and an imaging section configured to acquire an optical image of the sample plate formed by the illumination light, the imaging section being common to the plurality of light source units.

(Clause 2) In the MALDI mass spectrometer described in Clause 1, one of the plurality of light source units may be configured to emit light within a visible wavelength region.

(Clause 3) In the MALDI mass spectrometer described in Clause 1 or 2, one of the plurality of light source units may be configured to emit light within an ultraviolet wavelength region.

(Clause 4) In the MALDI mass spectrometer described in Clause 3, the ultraviolet wavelength region may be a region overlapping an absorption wavelength band of a matrix used for preparing the sample.

The MALDI mass spectrometer described in any one of Clauses 1-4 can acquire, for example, two observation images of the same sample plate, with one image showing the sample plate illuminated with light within the visible wavelength region and the other image showing the sample plate illuminated with light within the ultraviolet wavelength region, and simultaneously display both images or one of them selectively. Therefore, the device can properly present the user the position of the sample formed on the sample or its state of adhesion, regardless of the kind of matrix used for preparing the sample or the state of the formed sample, thereby allowing the user to locate, for example, a sweet spot at which a high level of signal intensity can be obtained in the sample.

(Clause 5) The MALDI mass spectrometer described in one of Clauses 1-4 may further include an input unit configured to allow a user to give an instruction for the switching of the illumination light, where the illumination light switching section is configured to switch the illumination light according to the instruction given through the input unit.

The MALDI mass spectrometer described in Clause 5 allows a user to select and display an observation image acquired under illumination which produces an easy-to-watch condition for the user. Accordingly, for example, even an operator who is accustomed to watching images under illumination with visible light can properly determine the laser irradiation point while watching the displayed observation image.

(Clause 6) In the MALDI mass spectrometer described in one of Clauses 1-4, the illumination light switching section may be configured to switch the illumination light in order at regular intervals of time.

The MALDI mass spectrometer described in Clause 6 can simultaneously or sequentially display observation images acquired under different illuminating conditions, without depending on an instruction or operation by the user. Accordingly, for example, even when it is impossible to previously determine which of the visible and ultraviolet regions is suitable for the illumination, the operator can properly determine the laser irradiation point by watching the displayed observation images.

(Clause 7) The MALDI mass spectrometer described in Clause 5 or 6 may further include a display processor configured to display, on a screen of a display unit, an observation image created in real time based on a signal from the imaging section.

The MALDI mass spectrometer described in Clause 7 can provide a user with a real-time image acquired under a predetermined type of illumination, such as the visible light or ultraviolet light.

(Clause 8) The MALDI mass spectrometer described in Clause 5 or 6 may further include a display processor configured to display, on a screen of a display unit, a plurality of observation images respectively corresponding to the plurality of light source units, based on signals from the imaging section, where one of the observation images corresponds to the illumination light cast onto the sample plate at that point in time and is a real-time image continuously updated with the passage of time, while another one of the observation images is a snap image acquired at a predetermined point in time.

(Clause 9) In the MALDI mass spectrometer described in Clause 8, the predetermined point in time may be a point in time immediately before a point in time where the illumination light is switched by the illumination light switching section.

In the MALDI mass spectrometer described in Clause 8 or 9, a real-time image and a snap image respectively acquired under illumination light with different wavelength bands can be displayed next to or superimposed on each other. This allows the user to determine an appropriate laser irradiation point by comparing a plurality of observation images or selecting an observation image which is easier for the user to watch.

(Clause 10) One mode of the storage medium recording a program for a MALDI mass spectrometer according to the present invention is a computer readable storage medium recording a computer program to be used for a MALDI mass spectrometer configured to irradiate a sample on a sample plate with laser light to ionize a component in the sample and perform a mass spectrometric analysis of the component, the MALDI mass spectrometer further configured to selectively cast one of a plurality of beams of light emitted from a plurality of light source units each of which is configured to emit a beam of light with a different wavelength region, onto the sample plate as illumination light, and acquire, with an imaging section, an optical image of the sample plate formed by the illumination light, and the computer program configured to make a computer function as:

a display-processing functional section configured to display, on a screen of the same display unit, a plurality of observation images acquired for the sample plate in which one of the observation images is displayed as a real-time image continuously updated with the passage of time and another one of the observation images is displayed as a snap image which is a still image acquired at a predetermined point in time; and an illumination-light-switching control functional section configured to control a switching operation of the illumination light so that a beam of light emitted from a specific light source unit among the plurality of light source units is cast onto the sample plate as the illumination light when the real-time image is being updated, and a beam of light emitted from a light source unit different from the specific light source unit among the plurality of light source units is cast onto the sample plate as the illumination light at the predetermined point in time specified for acquiring the snap image.

The storage medium recording a program for a MALDI mass spectrometer described in Clause 10 enables a computer to simultaneously display, on the screen of the display unit, two observation images of the same sample plate including, for example, one image showing the sample plate illuminated with visible light and the other image showing the sample plate illuminated with ultraviolet light. One of the observation images is a real-time image, in which the imaging range on the sample plate changes its position in real time when the position of the sample plate is changed. This allows the user to visually check the observation image of each of the samples at different positions on the sample plate or each of the different sites in the same sample. The other observation image is a snap image, which allows the user to visually check the observation image reflecting the state of a sample on the sample plate observed at the predetermined point in time, despite the change in the position of the sample plate. Thus, by using the storage medium recording a program for a MALDI mass spectrometer described in Clause 10, the user can more properly and efficiently check the position of the sample formed on the sample plate, its state of adhesion and other related conditions.

(Clause 11) In the storage medium recording a program for a MALDI mass spectrometer described in Clause 10, the illumination-light-switching control functional section may be configured to control the light source units so as to switch the illumination light according to an illumination-switching instruction given through an input unit by a user so that the light source unit corresponding to a selection by the user is used as the specific light source unit whose emission light is cast onto the sample plate as the illumination light, and the display-processing functional section may be configured to display, as the real-time image, an observation image acquired under illumination with the emission light from the specific light source unit.

The storage medium recording a program for a MALDI mass spectrometer described in Clause 11 allows the user to select an observation image acquired under illumination which produces an easy-to-watch condition for the user, and display it as the real-time image. Accordingly, for example, an operator who is accustomed to watching images under illumination with visible light can properly determine the laser irradiation point by watching the real-time visible-light image while additionally referring to the ultraviolet-light image taken as a snap image. The user can also appropriately switch the observation image to be displayed as the real-time image according to the kind of matrix, state of distribution of the matrix and other related conditions.

(Clause 12) In the storage medium recording a program for a MALDI mass spectrometer described in Clause 10, the illumination-light-switching control functional section may be configured to control the light source units so as to switch the illumination light in order at regular intervals of time, and the display-processing functional section may be configured to display, as the real-time image, an observation image acquired under illumination light which is cast onto the sample plate, and to display, as the snap image, an observation image corresponding to illumination light which is not cast onto the sample plate.

By the storage medium recording a program for a MALDI mass spectrometer described in Clause 12, real-time images acquired under different illuminating conditions can be sequentially displayed, without depending on an instruction or operation by the user. Accordingly, for example, even when it is difficult to determine which of the visible and ultraviolet light is suitable for acquiring observation images, the operator can properly determine the laser irradiation point by watching the displayed real-time image and snap image.

(Clause 13) In the storage medium recording a program for a MALDI mass spectrometer described in one of Clauses 10-12, the predetermined point in time may be a point in time immediately before a point in time where the illumination light is switched by the illumination-light-switching control functional section.

By the storage medium recording a program for a MALDI mass spectrometer described in Clause 13, every time the illumination light is switched, the latest snap image can always be displayed.

REFERENCE SIGNS LIST

10 . . . Vacuum Chamber
100 . . . Window
11 . . . Vacuum Pump
12 . . . Laser Emitter
13 . . . Half Mirror
14 . . . Sample Stage
15 . . . Sample Plate
151 . . . Well
152 . . . Sample
16 . . . Stage Driver
17 . . . Extraction Electrode
18 . . . Quadrupole Deflector
20 . . . Ion Trap
21 . . . Ring Electrode
22 . . . Entrance End-Cap Electrode
23 . . . Ion Injection Hole
24 . . . Exit End-Cap Electrode
25 . . . Ion Ejection Hole
26 . . . Detector
**30*a*** . . . Visible Light Source
**30*b*** . . . Ultraviolet Light Source
31 . . . Illumination Driver
32 . . . Visible-Light Camera
40 . . . Control-and-Processing Unit
41 . . . Analysis Controller
42 . . . Observation Image Acquisition Controller
43 . . . Acquired Image Processor
44 . . . Display Processor
45 . . . Data Processor
46 . . . Input/Output Processor
47 . . . Input Unit
48 . . . Display Unit

The invention claimed is:

1. A MALDI mass spectrometer configured to irradiate a sample on a sample plate with laser light to ionize a component in the sample and perform a mass spectrometric analysis of the component, the MALDI mass spectrometer comprising:

a plurality of light source units each of which is configured to emit a beam of light with a different wavelength region;

an illumination light switching section configured to selectively cast one of the beams of light emitted from the plurality of light source units, onto the sample plate as illumination light; and an imaging section configured to acquire an optical image of the sample plate formed by the illumination light, the imaging section being common to the plurality of light source units.

2. The MALDI mass spectrometer according to claim 1, wherein one of the plurality of light source units is configured to emit light within a visible wavelength region.

3. The MALDI mass spectrometer according to claim 1, wherein one of the plurality of light source units is configured to emit light within an ultraviolet wavelength region.

4. The MALDI mass spectrometer according to claim 3, wherein the ultraviolet wavelength region is a region overlapping an absorption wavelength band of a matrix used for preparing the sample.

5. The MALDI mass spectrometer according to claim 1, further comprising an input unit configured to allow a user to give an instruction for switching of the illumination light, where the illumination light switching section is configured to switch the illumination light according to the instruction given through the input unit.

6. The MALDI mass spectrometer according to claim 5, further comprising a display processor configured to display, on a screen of a display unit, an observation image created in real time based on a signal from the imaging section.

7. The MALDI mass spectrometer according to claim 5, further comprising a display processor configured to display, on a screen of a display unit, a plurality of observation images respectively corresponding to the plurality of light source units, based on signals from the imaging section, where one of the observation images corresponds to the illumination light cast onto the sample plate at that point in time and is a real-time image continuously updated with a passage of time, while another one of the observation images is a snap image acquired at a predetermined point in time.

8. The MALDI mass spectrometer according to claim 7, wherein the predetermined point in time is a point in time immediately before a point in time where the illumination light is switched by the illumination light switching section.

9. The MALDI mass spectrometer according to claim 1, wherein the illumination light switching section is configured to switch the illumination light in order at regular intervals of time.

10. The MALDI mass spectrometer according to claim 9, further comprising a display processor configured to display, on a screen of a display unit, an observation image created in real time based on a signal from the imaging section.

11. The MALDI mass spectrometer according to claim 9, further comprising a display processor configured to display, on a screen of a display unit, a plurality of observation images respectively corresponding to the plurality of light source units, based on signals from the imaging section, where one of the observation images corresponds to the illumination light cast onto the sample plate at that point in time and is a real-time image continuously updated with a passage of time, while another one of the observation images is a snap image acquired at a predetermined point in time.

12. The MALDI mass spectrometer according to claim 11, wherein the predetermined point in time is a point in time immediately before a point in time where the illumination light is switched by the illumination light switching section.

13. A computer readable storage medium recording a program to be used for a MALDI mass spectrometer configured to irradiate a sample on a sample plate with laser light to ionize a component in the sample and perform a mass spectrometric analysis of the component, the MALDI mass spectrometer further configured to selectively cast one of a plurality of beams of light emitted from a plurality of light source units each of which is configured to emit a beam of light with a different wavelength region, onto the sample plate as illumination light, and acquire, with an imaging section, an optical image of the sample plate formed by the illumination light, wherein the computer program is configured to make a computer function as:

a display-processing functional section configured to display, on a screen of a same display unit, a plurality of observation images acquired for the sample plate in which one of the observation images is displayed as a real-time image continuously updated with the passage of time and another one of the observation images is displayed as a snap image which is a still image acquired at a predetermined point in time; and an illumination-light-switching control functional section configured to control a switching operation of the illumination light so that a beam of light emitted from a specific light source unit among the plurality of light source units is cast onto the sample plate as the illumination light when the real-time image is being updated, and a beam of light emitted from at least a light source unit different from the specific light source unit among the plurality of light source units is cast onto the sample plate as the illumination light at the predetermined point in time specified for acquiring the snap image.

14. The storage medium recording a program for a MALDI mass spectrometer according to claim 13, wherein:

the illumination-light-switching control functional section is configured to control the light source units so as to switch the illumination light according to an illumination-switching instruction given through an input unit by a user so that the light source unit corresponding to a selection by the user is used as the specific light source unit whose emission light is cast onto the sample plate as the illumination light; and the display-processing functional section is configured to display, as the real-time image, an observation image acquired under illumination with the emission light from the specific light source unit.

15. The storage medium recording a program for a MALDI mass spectrometer according to claim 13, wherein:

the illumination-light-switching control functional section is configured to control the light source units so as to switch the illumination light in order at regular intervals of time; and the display-processing functional section is configured to display, as the real-time image, an observation image acquired under illumination light which is cast onto the sample plate, and to display, as the snap image, an observation image corresponding to illumination light which is not cast onto the sample plate.

16. The storage medium recording a program for a MALDI mass spectrometer according to claim 13, wherein:

the predetermined point in time is a point in time immediately before a point in time where the illumination light is switched by the illumination-light-switching control functional section.

* * * * *